US008002231B2

(12) United States Patent
Tallent et al.

(10) Patent No.: US 8,002,231 B2
(45) Date of Patent: Aug. 23, 2011

(54) ADJUSTABLE SUPPORT DEVICE

(75) Inventors: Donald Lee Tallent, Peoria, AZ (US); Mark James Paulson, Gilbert, AZ (US)

(73) Assignee: Avnet, Inc., Phoenix, AZ (US)

( * ) Notice: Subject to any disclaimer, the term of this patent is extended or adjusted under 35 U.S.C. 154(b) by 400 days.

(21) Appl. No.: 12/266,606

(22) Filed: Nov. 7, 2008

(65) Prior Publication Data

US 2010/0116950 A1 May 13, 2010

(51) Int. Cl.
*F16M 13/00* (2006.01)

(52) U.S. Cl. ..... 248/544; 248/130

(58) Field of Classification Search ..... 248/129, 248/130, 132, 149, 544, 688, 125.7, 125.9, 248/146, 291.1
See application file for complete search history.

(56) References Cited

U.S. PATENT DOCUMENTS

| | | | | |
|---|---|---|---|---|
| 5,090,648 | A * | 2/1992 | Wood, IV | 248/125.3 |
| 5,165,632 | A * | 11/1992 | Kuan | 248/129 |
| 5,449,138 | A * | 9/1995 | Ciancio | 248/123.2 |
| 2003/0222186 | A1* | 12/2003 | Kim | 248/129 |
| 2009/0309322 | A1* | 12/2009 | Selvig et al. | 280/33.996 |
| 2010/0090071 | A1* | 4/2010 | Gothard et al. | 248/129 |

OTHER PUBLICATIONS

*Tsudakoma Rotary Table Selection Guides*; Internet Advertisement; www.komaprecision.com/TsudakomaGuides.html; last accessed Feb. 2, 2009 (2 pages).

*Techno Inc., Linear Motion Systems*; Internet Advertisement; www.techno-isel.com/tic/LinMoProducts.htm?gclid+C130iLzahZMCFSAdagod7gizew ; last accessed Feb. 2, 2009 (3 pages).

*Compact Transporter; ergo-tranz*; Advertisement Brochure; www.ergotechinc.com/pdf/BROCHURE,%20ErgoTranz.pdf; last accessed Feb. 3, 2009 (4 pages).

*Ergo Tech; Productivity Through Ergonomics*; Internet Advertisement; www.ergotechinc.com/op_ergo_master.htm; last accessed Feb. 3, 2009 (3 pages).

* cited by examiner

*Primary Examiner* — Ramon O Ramirez
(74) *Attorney, Agent, or Firm* — Fish & Richardson P.C.

(57) ABSTRACT

A support device includes a support frame, an arm, a first tray, and a second tray. The support frame is configured to rest on a support surface. The arm is coupled to the support frame and configured to rotate between at least a first position and a second position about a central axis substantially parallel to the support surface. The first tray is coupled to the arm and configured to rotate about a first axis substantially parallel to the central axis as the arm rotates between the first and second positions. The second tray is coupled to the arm and configured to rotate about a second axis substantially parallel to the central axis as the arm rotates between the first and second positions.

25 Claims, 8 Drawing Sheets

ADJUSTABLE SUPPORT DEVICE

TECHNICAL BACKGROUND

This disclosure relates to supporting product during a commercial process by an adjustable support device and, more particularly, to supporting product during a commercial process with an adjustable cart.

BACKGROUND

Consumer and commercial product may often consist of multiple components or sub-systems that are integrated and assembled in order to form the final product. Such components or sub-systems may be manufactured at different locations or by different manufacturers. The components or sub-systems, once manufactured, may be shipped or transported to a central location to be integrated or assembled into the final product by one of the manufacturers or a third-party business enterprise. The business enterprise may need to complete several steps in order to produce the final product. For example, the business enterprise may need to unpack the components or sub-systems from their original packing, assemble and integrate the components or sub-systems into the product, perform quality control procedures on the product, and package the product for shipping to a purchaser or end-user. Each step within the process may involve the transport and movement of the components, sub-systems, or product, any of which may be excessive in weight for one or more persons to reasonably handle.

In a typical assembly and integration process, the components or sub-systems may arrive at a shipping dock of the business enterprise. Once the components or sub-systems are unpackaged and the particular components or sub-systems that make up a product are gathered together, they may be carted to an integration center of the business enterprise. The components or sub-systems may then be moved from the cart to a work center, where they are assembled into the product. The finished product may then be loaded back onto the cart and moved to a testing station, where it is removed from the cart and tested at the testing station. Once the testing procedure is complete, the product may then be returned to the cart and moved to an outbound shipping center, where it is removed from the cart and packaged. Once packaged, the product may then be shipped to the purchaser or end-user.

In such a process, there may be concern that the components, sub-systems, or product are moved an excessive number of times, thereby increasing the potential for material damage or worker injury. Further, excessive movement may increase a cycle time to assemble, test, and package the product. Additionally, a typical process as described above may not maximize production flow by allowing work on multiple products at the same time by a single worker.

SUMMARY

This disclosure relates to supporting product during a commercial process and, more particularly, to supporting product during a commercial process with an adjustable cart.

One general implementation of a support device includes a support frame, an arm, a first tray, and a second tray. The support frame is configured to rest on a support surface. The arm is coupled to the support frame and configured to rotate between at least a first position and a second position about a central axis substantially parallel to the support surface. The first tray is coupled to the arm and configured to rotate about a first axis substantially parallel to the central axis as the arm rotates between the first and second positions. The second tray is coupled to the arm and configured to rotate about a second axis substantially parallel to the central axis as the arm rotates between the first and second positions. In certain specific aspects of the general implementation, at least one of the first tray and the second tray may be oriented substantially parallel to the support surface as the arm rotates between the first and second positions. Further, the support device may include a tie rod coupled to at least one of the first and second trays, where the tie rod may at least partially maintain the first and second trays substantially parallel to the support surface as the arm rotates between the first and second positions. The support frame may include at least one wheel. The wheel may be a caster configured to swivel.

In particular aspects, the support frame may include a substantially U-shaped base and at least one support member coupled to the base. The support member may be configured to offset the central axis from the support surface a substantially fixed distance, where the arm may be rotatably coupled to the support member. At least one of the substantially U-shaped base, the support member, and the arm may be structural steel members. The substantially U-shaped base may be welded to the support member.

In specific aspects, the support device may further include a first clutch plate having a first aperture and a second clutch plate having a second aperture and a third aperture. The first and second apertures may be substantially aligned at the first position and the first and third apertures may be substantially aligned at the second position. The support device may further include an indexing control including a plunger and a cam. The arm may be substantially fixed at the first position when the plunger is secured through the first and second apertures. The arm may be substantially fixed at the second position when the plunger is secured through the first and third apertures. The cam may be configured to remove the plunger from at least one of the first, second, or third apertures.

At least one of the first clutch plate and second clutch plate may further include a plate lobe including a lobe aperture and an adjustable clamp comprising a rod insertable through the lobe aperture. The adjustable clamp may be configured to hold the first and second clutch plates together at a substantially fixed position when the clamp is substantially closed. The clamp may be configured to allow the second clutch plate to rotate relative to the first clutch plate when the clamp is substantially open.

In some aspects of the support device, the first position of the arm and the second position of the arm may be offset by approximately 90 degrees. Additionally, at least one of the first tray and the second tray may include a tray handle. The support device may further include a third tray coupled to a stationary shaft, where the stationary shaft may be coupled through at least one of the support frame, the first clutch plate, the second clutch plate and the arm. The third tray may be oriented substantially parallel to the support surface. The support device may further a steering handle.

Another general implementation includes a method of using a support device, where the support device includes a support frame configured to rest on a support surface; an arm coupled to the support frame and configured to rotate between at least a first position and a second position about a central axis substantially parallel to the support surface; a first tray coupled to the arm and configured to rotate about a first axis parallel to the central axis as the arm rotates between the first and second positions; and a second tray coupled to the arm and configured to rotate about a second axis parallel to the central axis as the arm rotates between the first and second positions. The method includes the steps of rotationally decoupling the arm and the support frame; rotating the arm between the first position and the second position; and rotationally coupling the arm and the support frame at the second position.

In more specific implementations, the method may further include the steps of placing at least one product kit on the first tray at a first location, where the product kit comprising one or more components of a product; assembling the product on the first tray; and moving the assembled product on the support device to a second location. The step of assembling the product on the first tray may include assembling the product on the first tray at a third location. The step of assembling the product on the first tray may include assembling the product on the first tray at a first distance from the support surface. The method may further include the steps of rotating the arm such that the first tray is at a second distance from the support surface, the second distance greater than the first distance; and removing the assembled product from the first tray located at the second distance from the support surface.

The support device used in the method may further include a first clutch plate having a first aperture; a second clutch plate having a second aperture, where one of the first or second clutch plates comprising a plate lobe including a lobe aperture; an indexing control; and an adjustable clamp. The indexing control may include a plunger configured to be inserted through the first and second apertures and a cam connected to the plunger. The step of rotationally decoupling the arm and the support frame may include the steps of rotating the cam to remove the plunger from the first and second apertures; and rotating the clamp from a tightened position to an expanded position such that one of the first clutch plate or the second clutch plate may rotate relative to the other of the first clutch plate or the second clutch plate.

Another general implementation of a support device includes a support frame configured to rest on a support surface; an arm coupled to the support frame via the support member and configured to rotate between at least a first position and a second position about a central axis substantially parallel to the support surface; a first tray; a second tray; a first clutch plate; and a second clutch plate. The support member is configured to offset the central axis from the support surface. The support frame includes at least one support member. The first tray is secured to the arm and configured to rotate about a first axis parallel to the central axis as the arm rotates between the first and second positions. The second tray is secured to the arm and configured to rotate about a second axis parallel to the central axis as the arm rotates between the first and second positions. The first clutch plate includes a first aperture and is rigidly coupled to the support frame via the support member. The second clutch plate is rigidly coupled to the arm and has a second aperture and a third aperture. The first and second apertures are substantially aligned at the first position and the first and third apertures are substantially aligned at the second position.

In more specific aspects of the support device, at least one of the first tray and the second may be oriented substantially parallel to the support surface as the arm rotates between the first and second positions. The support device may further include an indexing control including a plunger and a cam. The arm may be substantially fixed at the first position when the plunger is secured through the first and second apertures. The arm may be substantially fixed at the second position when the plunger is secured through the first and third apertures. The cam may be configured to remove the plunger from at least one of the first, second, and third apertures. Additionally, at least one of the first clutch plate and the second clutch plate may further include a lobe including a lobe aperture; and a clamp configured to hold the first and second clutch plates together at a substantially fixed position when the clamp is closed. The clamp may be configured to allow the second clutch plate to rotate relative to the first clutch plate when the clamp is open.

In more particular aspects, the first position of the arm and the second position of the arm may be offset by approximately 90 degrees. At least one of the first tray and the second tray may be oriented substantially parallel to the support surface as the arm rotates between the first and second positions. Further, the first tray may include a first protrusion having a first tray aperture, where a line between the first axis and the first tray aperture may be approximately 45 degrees from a line parallel to a longitudinal dimension of the arm. The second tray may include a second protrusion having a second tray aperture, where a line between the second axis and the second tray aperture may be approximately 45 degrees from the line parallel to the longitudinal dimension of the arm. The support device may further include an articulated tie rod coupled to a point fixed relative to the support member, the first protrusion, and the second protrusion.

Various implementations of an adjustable cart according to the present disclosure may include one or more of the following features. For example, an adjustable cart may allow for a reduction of movement of a product as it is assembled from components or sub-systems. An adjustable cart may also allow for a product to be transported among several stations in an assembly process on a single support device. As another example, an adjustable cart may allow for the assembly of multiple products simultaneously by one or more workers while minimizing a space needed for assembly. As yet a further example, an adjustable cart may allow for easier or safer handling of one or more fully or partially assembled products by one worker. An adjustable cart may also allow for easier or safer handling of one or more fully or partially assembled products without the use of other equipment (e.g., forklifts, pallet jacks). As another example, an adjustable cart may function as a workbench and allow one or more fully or partially assembled products to remain upright at multiple heights.

Various implementations of an adjustable cart according to the present disclosure may also include one or more of the following features. For instance, an adjustable cart may allow a fully or partially assembled product to be loaded or removed at multiple heights as needed. An adjustable cart may also allow one or more fully or partially assembled products to remain level during height adjustment. As a further example, an adjustable cart may allow a worker to assemble a product at one or more distinct ergonomic positions. An adjustable cart may also support one or more products, which weigh approximately 300 lbs. each without overturning. As another example, an adjustable cart may allow for a product to remain on a single support device throughout an assembly cycle, thereby reducing the assembly cycle time.

These general and specific aspects may be implemented using a device, system or method, or any combinations of devices, systems, or methods. The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

An adjustable cart may support, transport, or otherwise manage products, parts, components, sub-systems, or systems during one or more processes. For example, the adjustable cart may support several parts or components being assembled into a final product for sale, shipment, or storage. In some aspects, the final product may be an electrical, electronic, or computer-based system, such as a laptop computer or server. The adjustable cart may include two or more trays attached to a rotatable armature. The armature may be securely attached to a support frame of the adjustable cart at a midpoint of the length of the armature and rotate about a central axis extending through the midpoint. As the armature rotates about the central axis, one or more of the trays coupled to the armature also rotate about the central axis. Each tray may also rotate about a secondary axis oriented parallel to the central axis and offset from the central axis at the point of coupling of the tray and the armature. In such a fashion, the one or more rotating trays may remain substantially horizontal or flat during rotation, thereby ensuring that parts, components, or product loaded on the trays are sufficiently supported by the trays. Rotation of the armature and trays may allow for a user of the adjustable cart to unload or load the trays with parts, components, or product at one or more of a range of heights. In such a manner, the user may work on or otherwise manage the parts, components, or product in a more ergonomic fashion.

The adjustable cart may also be sufficiently mobile such that it may be rolled, wheeled, or otherwise moved between and among several locations in a particular process. For example, in an assembly process, parts or sub-systems may be received at a first location (or at multiple locations by moving the cart, for example, among different locations in a warehouse or other inventory storage area) in the process and loaded on the adjustable cart at the first location (or the multiple locations). The loaded adjustable cart may then be moved to a second location where a final product is assembled from the parts or sub-system. The adjustable cart loaded with the final product may then be moved to a third location from which the final product is unloaded and shipped, packaged, or stored. In such a manner, the final product may be supported, moved, and managed on the adjustable cart at all or substantially all points of the assembly process.

Figure 1A:
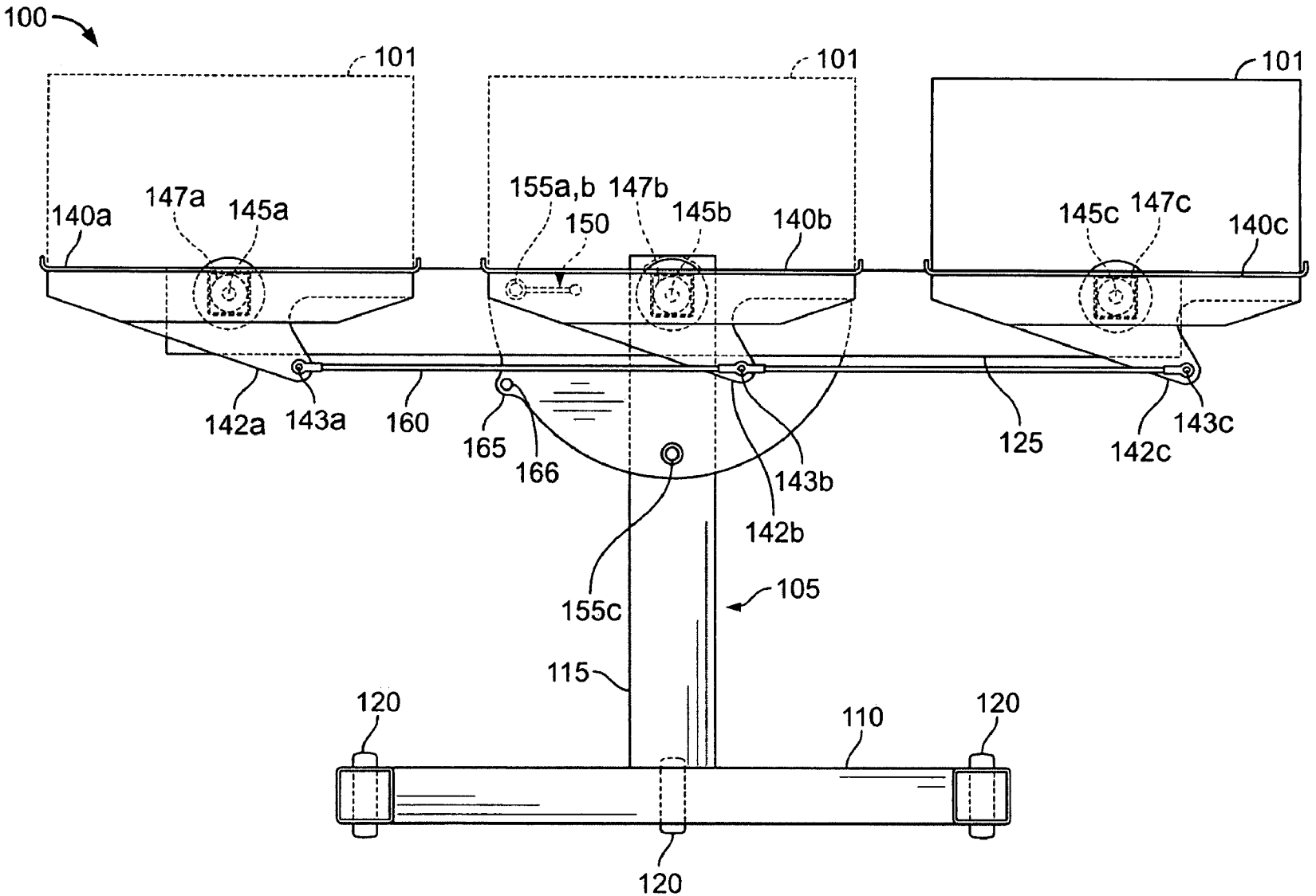
FIGS. 1A-C illustrate front, top, and side views of one implementation of an adjustable cart.
Figure 1B:
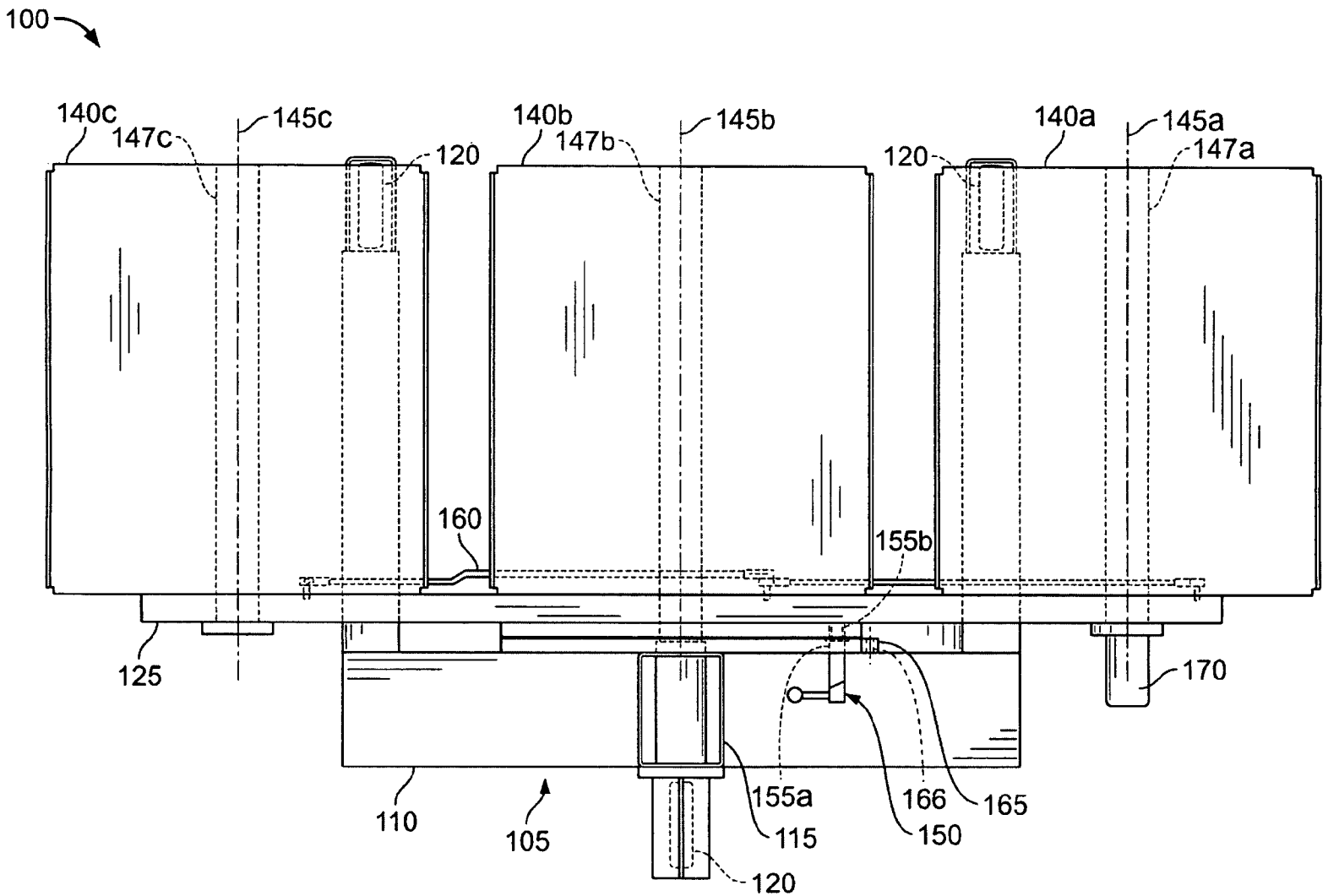
Figure 1C:
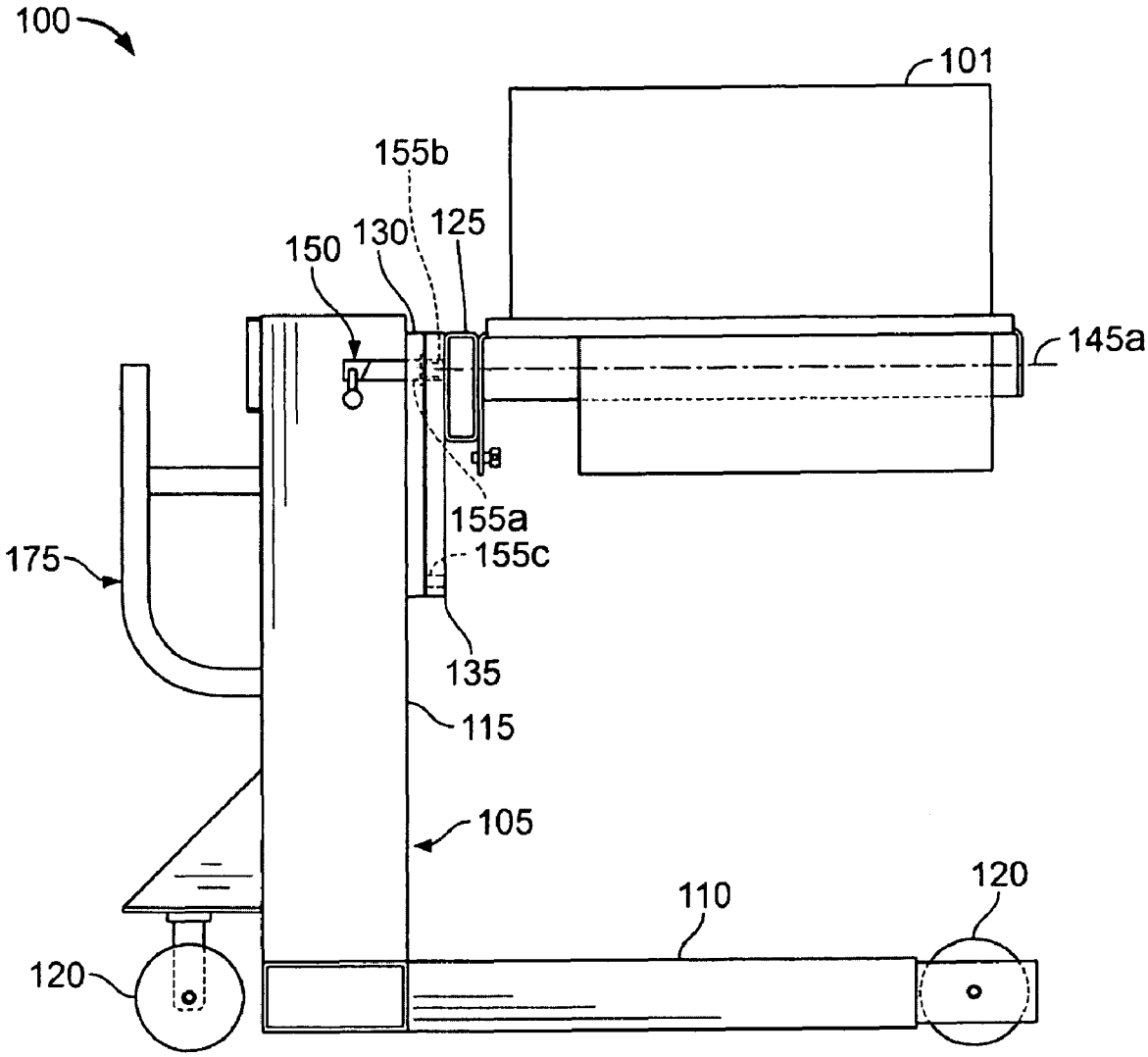

FIGS. 1A-C illustrate front, top, and side views of one implementation of one example of an adjustable cart. In general, FIGS. 1A-C illustrate an adjustable cart 100 that allows one or more product kits 101 to be assembled and transported by one or more users without requiring loading or unloading of the product kit 101 during the assembly or transport process. The adjustable cart 100 also allows the user to adjust a height of the product kit 101 from the floor on which the adjustable cart 100 rests, thereby providing that the product kit 101 remains at the most ergonomically appropriate location for the user to assemble, load, unload, or transport the product kit 101. Typically, a product kit 101 is a selection of one or more components, which, when assembled, forms a final product. The final product may be a residential or commercial product of any type. For example, the product kit 101 may consist of various electronic or electrical components obtained from one or more distinct manufacturers, which, when assembled, forms a computing device or electronic system, such as a server, computer, or computer peripheral.

FIG. 1A depicts a front view of the adjustable cart 100. The adjustable cart 100 includes a support frame 105; an arm 125; trays 140*a*, 140*b*, and 140*c*; a tie rod 160; and a rotational plate 135. As shown in FIGS. 1B and 1C, the adjustable cart 100 also includes a stationary plate 130; an indexing handle 150; a handle 170; and a steering handle 175. Typically, the support frame 105 provides a structure on which the other components of the adjustable cart 100 may be coupled to and thereby supported above the floor. The arm 125 rotates relative to the support frame 105 such that one or more of the trays 140*a*, 140*b*, and 140*c* may be positioned at various heights from the floor. The trays 140*a-c* support one or more product kits 101 and, for example, provide a work surface to assemble one or more product kits 101.

The support frame 105 includes a support base 110, a support member 115, and one or more wheels 120. The support base 110 is coupled or attached to the support member 115 and provides a base for the adjustable cart 100 such that the adjustable cart 100 remains upright and steady during movement of the cart 100 or rotation of the arm 125. The support base 110, as illustrated, is a substantially U-shaped support base, which, in some aspects, may support one or more product kits 101 having substantial weights (e.g., each weighing approximately three hundred pounds). The support base 110 may be made of cast iron, alloy steel, carbon steel, stainless steel, or aluminum. Alternatively, the support base 110 may be titanium or other type of metal, however, the support base may be made from any appropriate material depending on the mechanical properties required to support one or more product kits 101. The support base 110 may consist of two or more components welded or otherwise mechanically fastened together, or, in some aspects, may be a single piece support base.

The support base 110 may include one or more wheels 120, which allow the adjustable cart 100 to be rolled or otherwise moved. As illustrated in FIGS. 1A-C, the adjustable cart 100 may include three wheels 120, with two wheels 120 located at distal ends of the U-shaped support base and a single wheel 120 located near a base end of the support member 115. In some implementations, the wheel 120 located near the base of the support member 115 may be a fully rotatable caster wheel, which may allow the user of the adjustable cart 100 to turn or otherwise steer the cart 100 as it is rolled or moved between various locations or stations of an assembly, manufacturing, packaging, or shipping process. More than three wheels 120 may, in some aspects, be utilized with the adjustable cart 100, and more than one of the wheels may be caster wheels. Turning briefly to FIG. 1C, the adjustable cart 100 may include a steering handle 175 coupled or attached to the support member 115. The steering handle 175 may allow the user to turn or otherwise steer the adjustable cart 100 in combination with a fully rotatable caster wheel located positioned as the wheel 120 near the base of the support member 115. In some aspects, the steering handle 175 may be formed of the same material as the support frame 105 and welded or otherwise mechanically attached to the support member 115. Alternatively, the steering handle 175 may be formed of any appropriate material, such as polyvinylchloride (PVC) or other plastic. Although one configuration of the steering handle is depicted in FIG. 1C, other configurations are possible (e.g., using two or more horizontally separated handles for improving leverage).

The support member 115 is a substantially vertical structural member attached to the support base 110 and coupled to the arm 125 by a central shaft 147*b*. Generally, the support member 115 allows the arm 125 and additional components of the adjustable cart 100 that are coupled to the arm 125 to be raised a fixed distance from the floor. Although illustrated as a single support member 115, multiple support members may also be utilized. For example, two support members 115 may be angularly coupled to the support base 110 and meet at a point a fixed distance from the floor. The support member 115, like the support base 110, may be made of cast iron, alloy steel, carbon steel, stainless steel, or aluminum, as appropriate, and be welded or otherwise mechanically fastened (e.g., bolt, drive screw, adhesive) to the support base 110. In some aspects the support member 115 may be approximately 3 feet in length and have cross-section dimensions of 6 inches by 8 inches.

The central shaft 147*b* may be rigidly fastened to a top end of the support member 115 by, for example, three bolts evenly spaced approximately 120 degrees apart. In some aspects, for instance, the central shaft 147*b* may penetrate through the support member 115 and be bolted to the support member 115 on a back side of the member 115 near the steering handle 175. Further, the central shaft 147*b* may be approximately 3.5 inches in diameter. A central axis 145*b* is located at the center of the central shaft 147*b* and extends through the shaft 147*b* substantially parallel to the floor.

In some implementations, the stationary plate 130 is formed in a half-circle shape and is rigidly attached to the support member 115 by welding or other mechanical fastening procedure, such as bolts or drive screws. The stationary plate 130 may also include a substantially circular aperture through which the central shaft 147*b* may be inserted. In some implementations, the stationary plate 130 may include a plate lobe 165 extending from an edge of the stationary plate 130. The plate lobe 165 includes a lobe aperture, through which, with reference to FIG. 4B, a clamp 180 may be inserted and employed. As described more fully below with reference to FIG. 4B, the clamp 180 may allow the stationary plate 130 and the rotational plate 135 to be securely coupled together when the arm 125 is at any position.

The stationary plate 130 also includes an indexing aperture 155*a*. The indexing aperture 155*a* is, typically, substantially circular in form and extends through all or substantially all of the plate 130. In some aspects, at least a portion of an indexing handle 150 may be inserted through the indexing aperture 155*b*. As described in more detail below with respect to FIGS. 2, 3, and 4A, the indexing handle 150 may allow the stationary and rotational plates 130 and 135, respectively, to be securely coupled together when the arm 125 is, for example, at one of a substantially horizontal position or a substantially vertical position. In some implementations, other devices for indexing or maintaining a selected position of the arm 125 can be used.

The rotational plate 135 is located between the stationary plate 130 and the arm 125 and, typically, is formed in a half-circle shape also. Alternatively, the plates 130 and 135 may have substantially different shapes but maintain the same functionality. The rotational plate 135 is rigidly attached to the arm 125 by welding or other appropriate mechanical fasteners (e.g., bolts, drive screws, adhesive) and includes a substantially circular aperture through which the central shaft 147*b* may be inserted. Thus, the rotational plate 135 may rotate about the central shaft 147*b* upon rotation of the arm 125. In some implementations, the rotational plate 135 may include indexing apertures 155*b* and 155*c*, which may be spaced approximately 90 degrees apart along an outer edge of the rotational plate 135. Indexing apertures 155*b* and 155*c* may be substantially circular in form and extend through all or substantially all of the plate 135. In some aspects, the indexing aperture 155*b* of rotational plate 135 may be aligned or substantially aligned with the indexing aperture 155*a* of stationary plate 130 when, for instance, the arm 125 is substantially horizontal in orientation. Further, the indexing aperture 155*c* of the rotational plate 135 may be aligned or substantially aligned with the indexing aperture 155*a* of the stationary plate 130 when, for instance, the arm 125 is substantially vertical in orientation (as described more fully with reference to FIG. 3). In some aspects, the stationary and rotational plates 130 and 135, respectively, are approximately 1 inch thick and have a radius of approximately 13 inches. In some implementations, indexing apertures with other orientations can be used.

The arm 125 is coupled to the rotational plate 135 and includes a substantially circular aperture through which the central shaft 147*b* may be inserted. The arm 125 also includes additional substantially circular apertures through which a left shaft 147*a* and a right shaft 147*c* may be inserted through the arm 125. Each of the left shaft 147*a* and right shaft 147*c*, however, may rotate relative to the arm 125 upon rotation of the arm 125 about the central axis 145*b*. In other implementations, one or more of the shafts 147*a* and 147*c* may be fixed relative to the arm 125 while trays 140*a* and 140*c* may rotate relative to the respective shafts 147*a* and 147*c*.

In some aspects, the left and right shafts 147*a* and 147*c*, respectively, may be approximately 3 inches in diameter. A left axis 145*a* extends through the center of the left shaft 147*a* and is oriented substantially parallel to the floor and the central axis 145*b*. A right axis 145*c* extends through the center of the right shaft 147*c* and is also oriented substantially parallel to the floor and the central axis 145*b*. As shown in FIG. 1B, a handle 170 may be secured to the left shaft 147*a*. The handle 170 provides the user of the adjustable cart 100 a location at which to initiate and maintain rotation of the arm 125 about the central axis 147*b*. As with the components of the support frame 105, the arm 125 may, for example, be made of cast iron, carbon steel, alloy steel, stainless steel, aluminum, or titanium, as appropriate. Other materials (e.g. copper, bronze, PVC) may also be utilized depending on the mechanical properties required of the arm 125.

The trays 140*a*, 140*b*, and 140*c* are coupled to the left shaft 147*a*, central shaft 147*b*, and right shaft 147*c*, respectively, and provide a flat or substantially flat work surface or support surface for one or more product kits 101. For example, the trays 140*a-c* may be coupled to the shafts 147*a-c* by mechanical fastening such as bolts, screws, drive screws, or rivets. Further, in some aspects of the adjustable cart 100, there may be more or less trays than as illustrated in FIGS. 1A-C. In certain implementations, one or more of the trays 140*a-c* may be approximately 27 inches by 30 inches and have a depth of approximately 4 inches. Alternatively, the trays 140*a-c* may be any appropriate size depending on many factors, such as, for example, the dimensions of the product kit 101, the dimensions of the final product assembled from the product kit 101, a maximum floor space to used by the adjustable cart 100, or a weight of the product kit 101.

As depicted in FIG. 1A, one or more of the trays 140*a*, 140*b*, and 140*c* may include a tray lobe 142*a*, 142*b*, and 142*c*, respectively. Each tray lobe 142*a-c* may include a tray aperture 143*a-c*, respectively. As one example, tray lobe 142*a* angularly extends downward from a side of the tray 140*a* closest to the arm 125. The tray lobe 142*a* may be oriented such that a line between the left axis 145*a* and the tray aperture 143*a* is approximately 45 degrees offset from a line intersecting each of the axes 145*a-c* when the arm 125 is at a substantially horizontal orientation. The tray aperture 143*a* is formed in the tray lobe 142*a* and allows the tie rod 160 to be coupled to the tray 140*a*. In similar fashion, the tie rod 160 may also be coupled to the tray apertures 143*b* and 143*c* formed in tray lobes 142*b* and 142*c*, respectively. In such a fashion, the tray lobes 142*a-c* may always be oriented in a substantially similar direction regardless of the orientation of the arm 125. In some aspects of the adjustable cart 100, the shape of the tray lobes 142*a* and 142*c* may allow the corresponding trays 140*a* and 140*c*, respectively, to tuck within the U-shaped support base 110 as the arm 125 rotates about the central axis 145*b* into a substantially vertical position.

FIG. 1A illustrates the adjustable cart 100 with the arm 125 in a substantially horizontal orientation. In such fashion, each of the trays 140*a-c* may also be oriented substantially parallel to the floor and substantially flat, thereby allowing one or more product kits 101 to be placed on the trays 140*a-c*. Such a position of the arm 125 and trays 140*a-c* may be suitable for assembling or otherwise working on the product kits 101. Alternatively, however, this position may also be suitable for loading or unloading of one or more product kit 101. Furthermore, in this position, the indexing handle 150 may lock the stationary plate 130 and rotational plate 135 together (more fully described with reference to FIG. 4A), such that rotation of the arm 125 may be fully or substantially prevented. In addition, in some aspects, the clamp 180 may be utilized in this position of the adjustable cart 100 to more fully secure the stationary plate 130 and rotational plate 135 together, as is shown and described in FIG. 4B.

Figure 2:
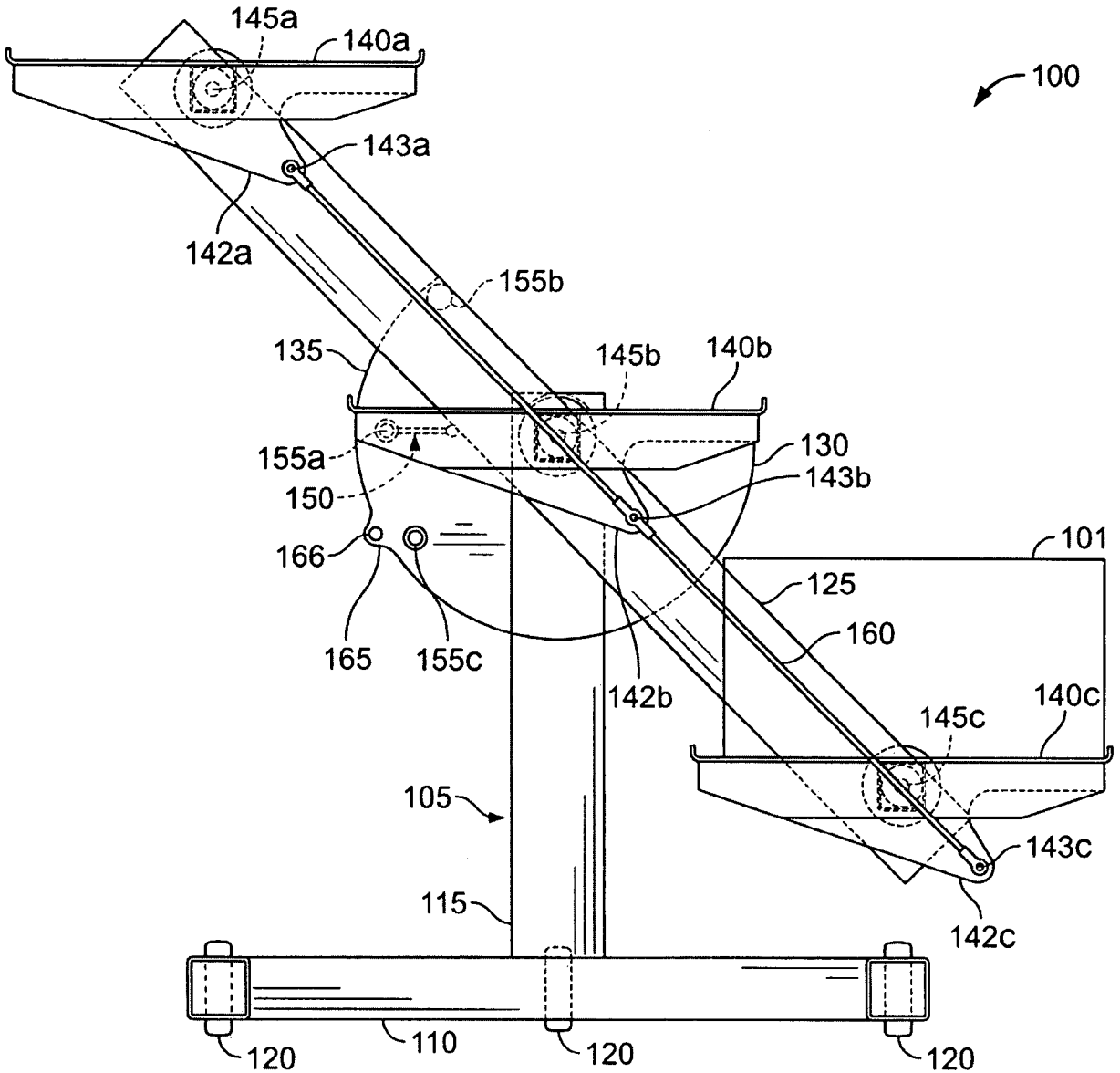
FIG. 2 illustrates one implementation of an adjustable cart at one rotated position.

FIG. 2 illustrates the adjustable cart 100 at a rotated position relative to the position depicted in FIG. 1. For example, a user of the adjustable cart 100 may desire to rotate the arm 125 in order to change the height of, for instance, trays 140*a* and 140*c*. In the rotated position, one or more product kits 101 supported by the trays 140*a-c* may be at a level suitable for loading or unloading. Alternatively, one or more final products supported by the trays 140*a-c* may be loaded or unloaded in the rotated position. The product kits 101 or products may be further assembled or otherwise worked on in the rotated position, as appropriate.

Typically, to orient the adjustable cart 100 to the rotated position from the horizontal position, the indexing handle 150 may be utilized to couple and decouple the rotational plate 135 from the stationary plate 130. Further, in some aspects, the clamp 180 may be utilized to further secure and unsecure the rotational plate 135 from the stationary plate 130. Once the rotational plate 135 is fully decoupled from the stationary plate 130, the user may initiate rotation of the arm 125 via, for example, the handle 170. The arm 125 may thus rotate back and forth in a complete or substantially complete circle or between two end points, which may correspond to substantially vertical and substantially horizontal positions of the arm 125, separated by approximately 90 degrees (as in the illustrated embodiment). During rotation of the arm 125 about the central axis 147*b*, the tray 140*b* may remain substantially fixed. The trays 140*a* and 140*c* may rotate about the left axis 145*a* and the right axis 145*c* on the left and right shafts 147*a* and 147*c*, respectively, thereby at least partially ensuring that the trays 140*a* and 140*c* remain substantially parallel to the floor during rotation. Furthermore, during rotation of the arm 125, the tie rod 160 may remain securely coupled to the tray apertures 143*a-c*, thereby also at least partially ensuring that the trays 140*a* and 140*c* remain substantially parallel to the floor. The tie rod 160 may, in some aspects, rotate about the tray aperture 143*b* during rotation of the arm 125 about the central axis 145*b*.

Once the user appropriately orients the locations of the trays 140*a* and 140*c*, the clamp 180 may be utilized to secure the rotational plate 135 to the stationary plate 130, thereby preventing or substantially preventing further rotation of the arm 125. Alternatively (or in addition to), the rotational plate 135 may include multiple indexing apertures in addition to indexing apertures 155*b-c*, thereby allowing an appropriately located indexing aperture to align with the indexing aperture 155*a* located on the stationary plate 130. In such aspects, the indexing handle 150 may be utilized to couple the rotational and stationary plates 130 and 135 securely to at least partially prevent further rotation by the arm 125.

Figure 3:
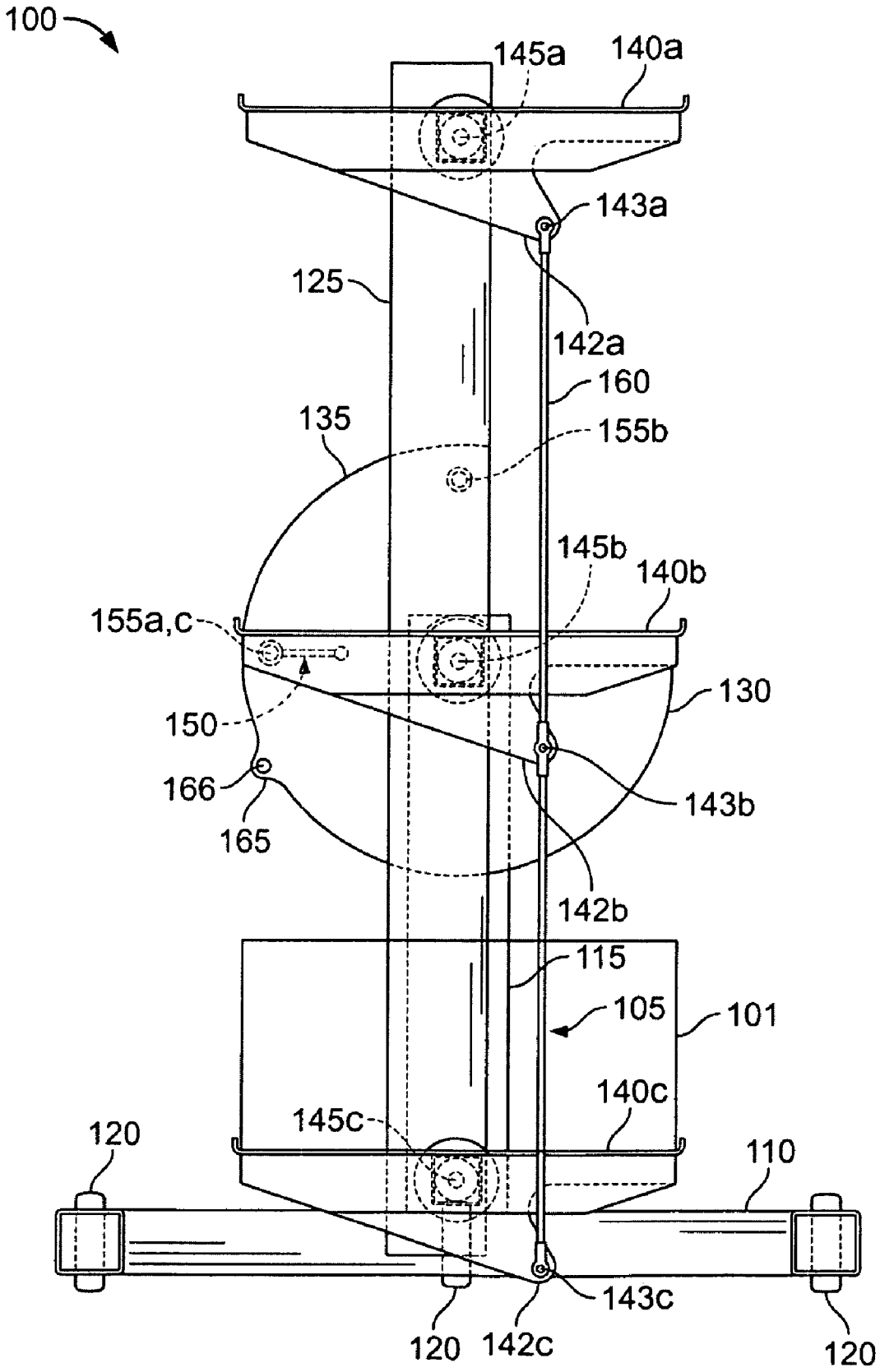
FIG. 3 illustrates one implementation of an adjustable cart at another rotated position.

FIG. 3 illustrates the adjustable cart 100 at another rotated position. More specifically, FIG. 3 illustrates the adjustable cart 100 when the arm 125 is in a substantially vertical position. In such a position, the tray 140*a* may reach its highest vertical position above the floor while the tray 140*c* resides at its lowest vertical position from the floor. In some aspects, the substantially vertical position may be utilized during loading and unloading of product kits 101 or final products. Alternatively, the substantially vertical position may also be utilized in the transportation process of the adjustable cart 100 between and among stations in, for example, an assembly or shipping process due to the decreased footprint of the adjustable cart 100 in this position. During rotation of the arm 125 to, and while situated at the substantially vertical position, the trays 140*a-c* may remain substantially parallel to the floor. During rotation of the arm 125, for instance, the trays 140*a* and 140*c* may rotate about the left axis 145*a* and the right axis 145*c*, respectively, thereby at least partially ensuring that the trays 140*a* and 140*c* remain substantially parallel to the floor during rotation. Furthermore, during rotation of the arm 125, the tie rod 160 may remain securely coupled to the tray apertures 143*a-c*, thereby also at least partially ensuring that the trays 140*a* and 140*c* remain substantially parallel to the floor.

In orienting the adjustable cart 100 from the rotated position illustrated in FIG. 2 to the substantially vertical position illustrated in FIG. 3, the user may first unsecure the rotational plate 135 from the stationary plate 130 via the clamp 180. If the indexing handle 150 also secures the plates 130 and 135 together, the user may decouple the plates 130 and 135 through the indexing handle 150 before rotation of the arm 125. Once decoupled, the user may rotate the arm 125 to the substantially vertical position by, for example, the handle 170. When the arm 125 reaches this position, the indexing aperture 155*c* located on the rotational plate 135 may be aligned or substantially aligned with the indexing aperture 155*a* located on the stationary plate 130. The user may then utilize the indexing handle 150 to couple the plates 130 and 135 together. In some implementations, the user may also utilize the clamp 180 to secure the rotational plate 135 to the stationary plate 130.

Figure 4A:
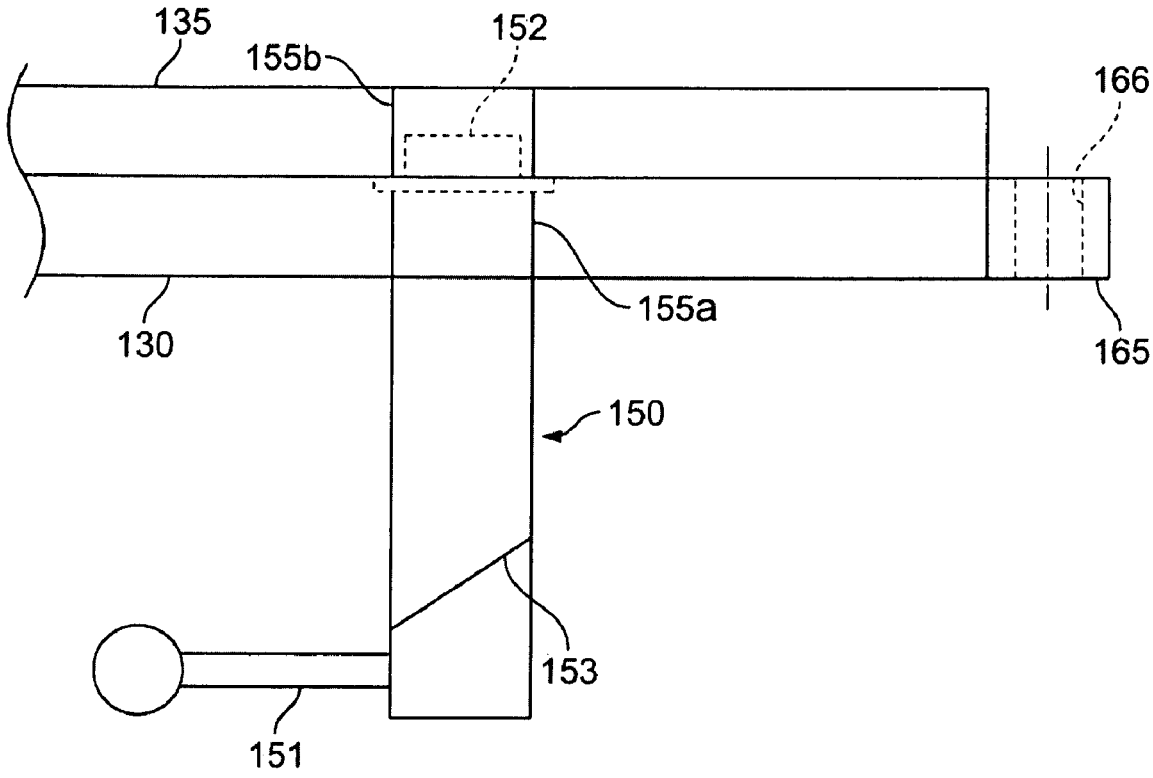
FIG. 4A illustrates one implementation of an indexing mechanism that may be used with an adjustable cart.

FIG. 4A illustrates one implementation of an indexing handle 150 that may be used with the adjustable cart 100. The indexing handle 150, as previously described, couples the rotational plate 135 and the stationary plate 130, thereby at least partially preventing rotation of the arm 125 about the central axis 145*b*. Generally, the indexing handle 150 includes a lever 151, a plunger 152, and a cam 153. The lever 151 provides an ergonomic grip for the user to grasp and rotate the cam 153. The cam 153 translates the rotational movement of the lever 151 to a reciprocating movement, thereby allowing for the plunger 152 to be inserted into and removed from the indexing apertures 155*a-c*. FIG. 4A, for example, illustrates the plunger 152 inserted into indexing apertures 155*a* and 155*b* located in the stationary plate 130 and the rotational plate 135, respectively. In some aspects of the adjustable cart 100, one or more of the indexing apertures 155*a-c* may include a bushing into which the plunger 152 fits. In some implementations, indexing may be achieved using alternative structures (e.g., a spring-loaded plunger attached to a round grip without the use of a cam or lever).

The plunger 152 is generally a substantially cylindrical member sized to be snugly inserted into one or more of the indexing apertures 155*a-c*. The plunger 152 may be made of the same or a substantially similar material as the support frame 105, one or both of the plates 130 and 135, and the arm 125, such as carbon steel, stainless steel, titanium, or aluminum, to name but a few. Regardless of the material, the plunger 152 may be of a material having a shear strength such that it prevents substantial movement of the rotational plate 135 relative to the stationary plate 130 while the trays 140*a-c* are under a load (e.g., supporting one or more product kits 101). The plunger 152, in some implementations, may be spring-loaded such that the plunger 152 snaps into the indexing apertures 55*b* or 155*c* on rotational plate 135 as each apertures becomes substantially aligned with the indexing aperture 155*a* on the stationary plate 130.

Figure 4B:
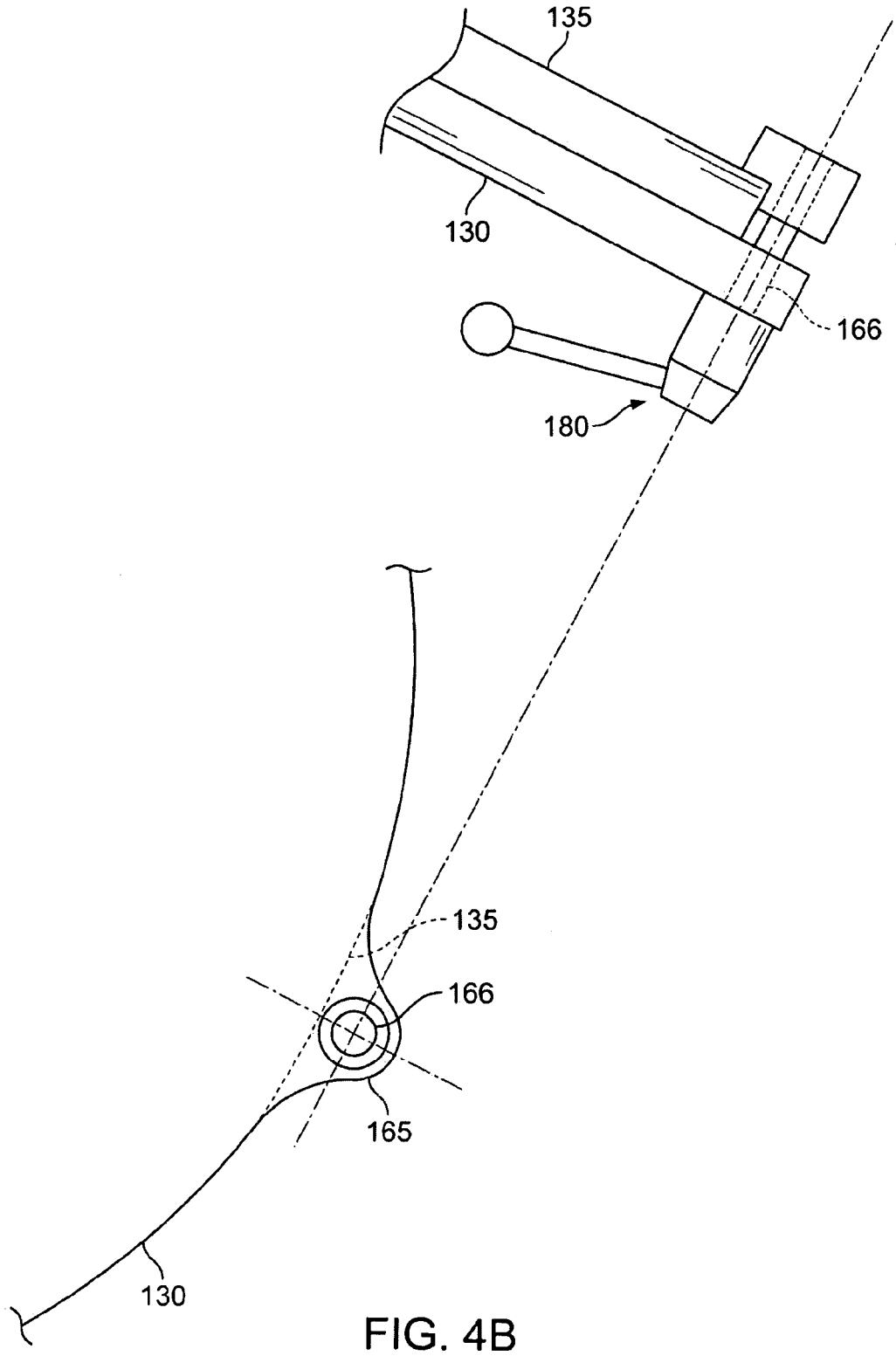
FIG. 4B illustrates one implementation of a fine tuning locking mechanism that may be used with an adjustable cart.

FIG. 4B illustrates one implementation of a fine tuning locking mechanism that may be used with an adjustable cart in accordance with the present disclosure. For example, in some implementations of the adjustable cart 100, the clamp 180 may operate as a fine tuning locking mechanism, thereby allowing the rotational plate 135 and stationary plate 130 to be secured at any one of the substantially infinite positions throughout the rotational swing of the arm 125 between the substantially horizontal position and the substantially vertical position. As described above and illustrated in FIG. 4B, the stationary plate 130 is adjacent the rotational plate 135 and includes the plate lobe 165. The plate lobe 165, generally, is an extended portion of the stationary plate 130 and includes a lobe aperture 166 throughout the entire thickness of the stationary plate 130.

As shown in FIG. 4B, the clamp 180 may be attached to the stationary plate 130 and include a through pin 167 that is inserted through the lobe aperture 166. The through pin 167, typically, may be a threaded rod member secured into the clamp 180. Upon rotation of the clamp 180 (e.g., counterclockwise rotation), the clamp 180 may expand, thereby allowing rotational movement of the rotational plate 135 relative to the stationary plate 130. In such a fashion, the user may rotate the arm 125 and orient the trays 140*a* and 140*c* at appropriate positions. Once the trays 140*a* and 140*c* are at the appropriate positions, the user may rotate the clamp 180 (e.g., clockwise rotation) to tighten the clamp 180 and secure the plates 130 and 135 from further rotation.

Figure 5:
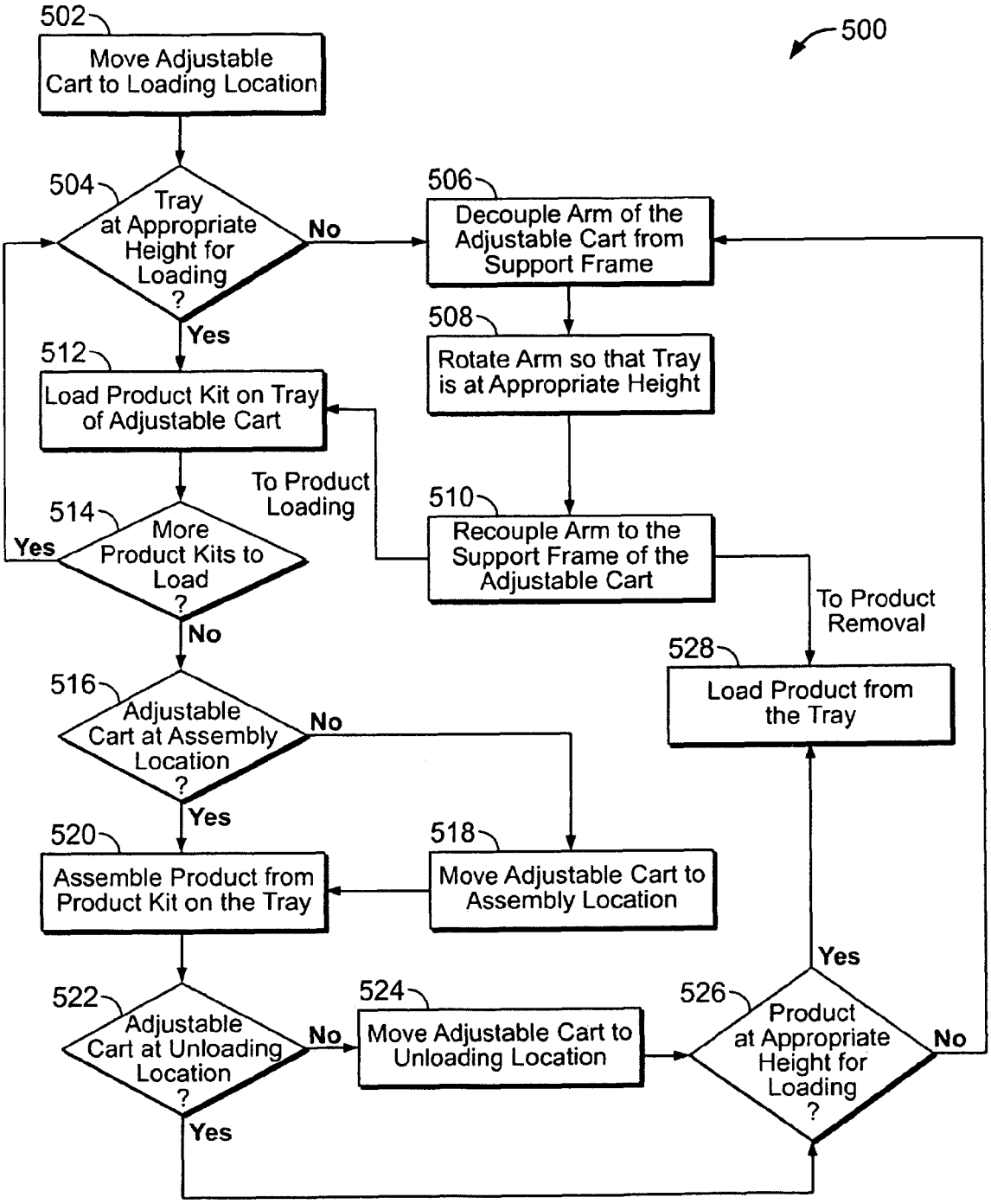
FIG. 5 illustrates one method of using an adjustable cart.

FIG. 5 illustrates one method 500 of using an adjustable cart as described in the present disclosure. For example, method 500 may be used with the adjustable cart 100 as described above, including, for instance, the support frame 105; the trays 140*a-c*; the arm 125; the central shaft 147*b* and left and right shafts 147*a* and 147*c*; the tie rod 160; and the stationary and rotational plates 130 and 135, respectively. In accordance with method 500, a user of an adjustable cart moves the cart to a loading location at 502. The loading location may be, for example, a shipping dock in a large warehouse, which receives parts, components, sub-systems, or product kits from one or more manufacturers. Further, the loading location may include an area where product kits are assembled from multiple parts, components, or sub-systems. The loading location, alternatively, may be any location in which one or more parts, components, or sub-systems are received, such as the front entrance of a small business enterprise.

The user then determines whether a tray of the adjustable cart is at an appropriate height for loading, for example, the product kit at 504. The tray may be substantially similar to any one of the trays 140*a-c* of the adjustable cart 100. The appropriate height of the tray may, for instance, depend on the weight or dimensions of the product kit to be loaded on the tray. Product kits weighing a substantial amount may need to be loaded onto the tray at significantly lower heights than, for example, product kits weighing very little. In some instances, the product kit to be loaded onto the tray may weigh approximately 300 pounds, thereby necessitating the tray be loaded as close to the floor as possible. Alternatively, the appropriate height for loading or unloading the tray may depend on the location of a product kit or product components on a storage rack.

Once the tray is at the appropriate height for loading, the product kit is loaded on the tray of the adjustable cart at 512. Alternatively, if the tray is not at the appropriate height for loading, the user may rotationally decouple an arm of the adjustable cart from a support frame of the adjustable cart at 506. For example, the arm and support frame of the adjustable cart may be substantially similar to the arm 125 and support frame 105, respectively, of the adjustable cart 100. In some aspects, decoupling the arm from the support frame may include using an indexing handle, which may be similar to the indexing handle 150, to decouple a rotational plate attached to the arm from a stationary plate attached to the support frame. The rotational plate and stationary plate may be substantially similar to the corresponding components of the adjustable cart 100. Further, in some aspects, rotationally decoupling the arm from the support frame may include unsecuring a clamp from the rotational and stationary plates, thereby allowing movement of the rotational plate relative to the stationary plate. The clamp may be substantially similar to the clamp 180 of the adjustable cart 100.

The user then rotates the arm so that the tray is at the appropriate height at 508. In some aspects, the user may use a handle coupled to the arm, such as the handle 170 coupled to the arm 125 on the adjustable cart 100. The user then recouples the arm to the support frame of the adjustable cart through, for example, the indexing handle, the clamp, or both at 510. Once the arm is recoupled, the user may load the product kit on the tray of the adjustable cart at 512. In some instances, the user may use other mechanical devices to load the product kit onto the tray, such as a pallet lift or forklift. Further, the user may repeat the process of loading one or more additional product kits product components onto one or more additional trays. For example, the user may determine whether there are more product kits or components to load onto the adjustable cart at 514. If there are additional product kits or components to load onto the adjustable cart, the user may repeat the loading process again by first determining whether a tray (e.g., the previously loaded tray or another tray) is at an appropriate height for loading at 504.

If there are no additional product kits to load, the user may then determine if the loaded adjustable cart is at an assembly location at 516. The assembly location may, for example, be an area or location distinct from the loading area, such as a different room or different warehouse. The assembly location, generally, is an area or portion of a process in which the product kit may be assembled or otherwise transformed into a final product. For example, the product kit may include one or more electrical or electronic components of a computer system, such as a server (i.e., the final product). Alternatively, the assembly location may be a part of or within the loading location.

If the loaded adjustable cart is not located at the assembly location, the user may transport the loaded adjustable cart to the assembly location by, for example, rolling the cart to the assembly location at 518. In some aspects, the adjustable cart may include one or more wheels or casters, such that the cart may be easily moved even under a full load (e.g., supporting one or more product kits or final products). For example, the adjustable cart may include three wheels similar to the wheels 120 on the adjustable cart 100. Alternatively, the adjustable cart may include tracks, glides, or other device used for mobility, either mechanized or manual.

Once the adjustable cart is located at the assembly location, the user (or additional users) may assemble the final product from the product kit on the tray at 520. The tray may, for instance, be utilized as a work surface or work bench during assembly of the product kit into the product. In some aspects, as when multiple product kits have been loaded on one or more trays of the adjustable cart, the user (or additional users) may assemble all of the product kits serially or in parallel. For instance, the adjustable cart may have three trays, which may be substantially similar to the trays 140*a-c* on the adjustable cart 100. The user may assemble a particular product kit located on each of the trays in order, or three users may assemble the product kits at the same time.

Once the assembly process of one or more product kits is completed, the user determines whether the adjustable cart is at an unloading location at 522. The unloading location may be, for example, a storage location, where products are stored for any length of time while awaiting purchase or shipment. Alternatively, the unloading location may be a packaging location. For instance, in some aspects, a product is packaged for shipment or sale on the tray on which it was assembled prior to unloading. The product, however, may also be unloaded prior to packaging. In certain implementations of method 500, the unloading location may be a shipping location identical or substantially identical to the loading location. Alternatively, the unloading location may be, for logistical purposes for instance, located separately from the loading location.

If the adjustable cart with the assembled product is not at the unloading location, the user may move the adjustable cart to the unloading location at 524. The user may then determine if the product is at an appropriate height for removal at 526. For example, certain product (like certain product kits) may require unloading at a particular height due to weight concerns. Certain product, for instance, may weigh approximately 300 pounds and may require unloading as close to the floor as possible. Alternatively, certain product (even product weighing an excessive amount) may be unloaded for storage at various heights, thereby requiring that the trays supporting the product be adjusted to account for these various heights.

If the product is not at the appropriate height for unloading, the user may begin the process of adjusting the tray height by rotationally decoupling the arm of the adjustable cart from the support frame at 506. As described above, in some aspects, rotationally decoupling the arm may include using the indexing handle, the clamp, or both to decouple the rotational plate from the stationary plate, thereby allowing the arm to be rotated relative to the support frame. The user then rotates the arm so that the tray is at the appropriate height for unloading the product at 508. The arm is then recoupled to the support frame of the adjustable cart at 510. The product may then be unloaded from the tray at 528.

A number of implementations have been described. Nevertheless, it will be understood that various modifications may be made. For example, method 500 may also include additional steps or less steps, as appropriate. For instance, the assembly process of the product kits may also include one or more adjustments to the height of one or more of the trays. In some aspects, assembly of a product kit into a product may be easiest, for ergonomic reasons, at multiple heights. Thus, after assembly of a portion of the product kit, the user may desire to adjust the height of the tray on which the assembly occurs. The user may then decouple the arm of the adjustable cart from the support frame at 506 and rotate the arm so that the tray is at the appropriate height at 508. Once at the appropriate height, the user may recouple the arm to the support frame of the adjustable cart at 510 and continue the assembly process. As another example, in some aspects, the user may repeat the tray adjustment and unloading process in order to unload several products from the adjustable cart. For instance, after the user unloads a product from a tray at 528, the user may determine if additional products need to be unloaded. If there is an additional product to be unloaded, the user may determine if the product is at an appropriate height for unloading at 526. If the additional product is not at an appropriate height, the user can adjust the height of the product through the arm adjustment process at 506-510. The user may then unload the additional product at 528. These additional steps are still in accordance with method 500. Further, the steps of method 500 may be executed in a different order than illustrated in FIG. 5. The adjustable cart 100 may also include less than or greater than three trays and may be configured to allow greater than or less than 90 degrees of rotation about a central axis. Accordingly, other implementations are within the scope of the following claims.

What is claimed is:

1. A support device comprising:

a support frame configured to rest on a support surface;

an arm coupled to the support frame and configured to rotate between at least a first position and a second position about a central axis substantially parallel to the support surface;

a first tray coupled to the arm and configured to rotate about a first axis substantially parallel to the central axis as the arm rotates between the first and second positions; and a second tray coupled to the arm and configured to rotate about a second axis substantially parallel to the central axis as the arm rotates between the first and second positions.

2. The support device of claim 1, wherein at least one of the first tray and the second tray is oriented substantially parallel to the support surface as the arm rotates between the first and second positions.

3. The support device of claim 2 further comprising a tie rod coupled to at least one of the first and second trays, the tie rod at least partially maintaining the first and second trays substantially parallel to the support surface as the arm rotates between the first and second positions.

4. The support device of claim 1, wherein the support frame comprises at least one wheel.

5. The support device of claim 1, wherein the at least one wheel comprises a caster configured to swivel.

6. The support device of claim 1, wherein the support frame comprises:

a substantially U-shaped base; and at least one support member coupled to the base and configured to offset the central axis from the support surface a substantially fixed distance, the arm rotatably coupled to the support member.

7. The support device of claim 6, wherein at least one of the substantially U-shaped base, the support member, and the arm comprise structural steel members, the substantially U-shaped base welded to the support member.

8. The support device of claim 1 further comprising:

a first clutch plate having a first aperture; and a second clutch plate having a second aperture and a third aperture, the first and second apertures substantially aligned at the first position, the first and third apertures substantially aligned at the second position.

9. The support device of claim 8 further comprising an indexing control, the indexing control comprising:

a plunger, the arm substantially fixed at the first position when the plunger is secured through the first and second apertures, the arm substantially fixed at the second position when the plunger is secured through the first and third apertures; and a cam configured to remove the plunger from at least one of the first, second, or third apertures.

10. The support device of claim 8, wherein at least one of the first clutch plate and second clutch plate further comprise:

a plate lobe including a lobe aperture; and an adjustable clamp comprising a rod insertable through the lobe aperture, the adjustable clamp configured to hold the first and second clutch plates together at a substantially fixed position when the clamp is substantially closed, the clamp configured to allow the second clutch plate to rotate relative to the first clutch plate when the clamp is substantially open.

11. The support device of claim 8 further comprising a third tray coupled to a stationary shaft, the stationary shaft coupled through at least one of the support frame, the first clutch plate, the second clutch plate; and the arm, the third tray oriented substantially parallel to the support surface.

12. The support device of claim 1, wherein the first position of the arm and the second position of the arm are offset by approximately 90 degrees.

13. The support device of claim 1, wherein at least one of the first tray and the second tray comprise a tray handle.

14. The support device of claim 1 further comprising a steering handle.

15. A method of using a support device, the support device comprising:

a support frame configured to rest on a support surface;

an arm coupled to the support frame and configured to rotate between at least a first position and a second position about a central axis substantially parallel to the support surface;

a first tray coupled to the arm and configured to rotate about a first axis parallel to the central axis as the arm rotates between the first and second positions; and a second tray coupled to the arm and configured to rotate about a second axis parallel to the central axis as the arm rotates between the first and second positions, the method comprising:

rotationally decoupling the arm and the support frame;

rotating the arm between the first position and the second position; and rotationally coupling the arm and the support frame at the second position.

16. The method of claim 15 further comprising:

placing at least one product kit on the first tray at a first location, the product kit comprising one or more components of a product;

assembling the product on the first tray; and moving the assembled product on the support device to a second location.

17. The method of claim 16, wherein assembling the product on the first tray comprises assembling the product on the first tray at a third location.

18. The method of claim 16, wherein assembling the product on the first tray comprises assembling the product on the first tray at a first distance from the support surface, the method further comprising:

rotating the arm such that the first tray is at a second distance from the support surface, the second distance greater than the first distance; and removing the assembled product from the first tray located at the second distance from the support surface.

19. The method of claim 15, the support device further comprising:

a first clutch plate having a first aperture;

a second clutch plate having a second aperture, one of the first or second clutch plates comprising a plate lobe including a lobe aperture;

an indexing control comprising:

a plunger configured to be inserted through the first and second apertures; and a cam connected to the plunger; and an adjustable clamp, wherein rotationally decoupling the arm and the support frame comprises:

rotating the cam to remove the plunger from the first and second apertures; and rotating the clamp from a tightened position to an expanded position such that one of the first clutch plate or the second clutch plate may rotate relative to the other of the first clutch plate or the second clutch plate.

20. A support device comprising:

a support frame configured to rest on a support surface, the support frame comprising at least one support member;

an arm coupled to the support frame via the support member and configured to rotate between at least a first position and a second position about a central axis substantially parallel to the support surface, the support member configured to offset the central axis from the support surface;

a first tray secured to the arm and configured to rotate about a first axis parallel to the central axis as the arm rotates between the first and second positions;

a second tray secured to the arm and configured to rotate about a second axis parallel to the central axis as the arm rotates between the first and second positions;

a first clutch plate having a first aperture, the first clutch plate rigidly coupled to the support frame via the support member; and a second clutch plate rigidly coupled to the arm and having a second aperture and a third aperture, the first and second apertures substantially aligned at the first position, the first and third apertures substantially aligned at the second position.

21. The support device of claim 20, wherein at least one of the first tray and the second is oriented substantially parallel to the support surface as the arm rotates between the first and second positions.

22. The support device of claim 20 further comprising an indexing control, the indexing control comprising:

a plunger, the arm substantially fixed at the first position when the plunger is secured through the first and second apertures, the arm substantially fixed at the second position when the plunger is secured through the first and third apertures; and a cam configured to remove the plunger from at least one of the first, second, and third apertures.

23. The support device of claim 20, wherein at least one of the first clutch plate and the second clutch plate further comprises a lobe comprising:

a lobe aperture; and a clamp configured to hold the first and second clutch plates together at a substantially fixed position when the clamp is closed, the clamp configured to allow the second clutch plate to rotate relative to the first clutch plate when the clamp is open.

24. The support device of claim 20, wherein the first position of the arm and the second position of the arm are offset by approximately 90 degrees, at least one of the first tray and the second tray oriented substantially parallel to the support surface as the arm rotates between the first and second positions.

25. The support device of claim 20, wherein the first tray includes a first protrusion having a first tray aperture, a line between the first axis and the first tray aperture being approximately 45 degrees from a line parallel to a longitudinal dimension of the arm, the second tray includes a second protrusion having a second tray aperture, a line between the second axis and the second tray aperture being approximately 45 degrees from the line parallel to the longitudinal dimension of the arm, the support device further comprising an articulated tie rod coupled to a point fixed relative to the support member, the first protrusion, and the second protrusion.

* * * * *

UNITED STATES PATENT AND TRADEMARK OFFICE

CERTIFICATE OF CORRECTION

PATENT NO. : 8,002,231 B2
APPLICATION NO. : 12/266606
DATED : August 23, 2011
INVENTOR(S) : Donald Lee Tallent and Mark James Paulson It is certified that error appears in the above-identified patent and that said Letters Patent is hereby corrected as shown below:

In column 15, line 33, in Claim 11, delete “plate;” and insert -- plate, --.

Signed and Sealed this
Thirty-first Day of January, 2012

David J. Kappos
*Director of the United States Patent and Trademark Office*